US005183209A

United States Patent [19]

Ricco et al.

[11] Patent Number: 5,183,209

[45] Date of Patent: Feb. 2, 1993

[54] ASSEMBLY OF AN ELECTROMAGNET CORE OF AN ELECTROMAGNETIC INTERNAL COMBUSTION ENGINE FUEL INJECTOR

[75] Inventors: Mario Ricco, Bari; Sisto L. De Matthaeis, Modugno; Domenico Maldera, Corato, all of Italy

[73] Assignee: Elasis Sistema Ricerca Fiat Nel Mezzogiorno Societa Consortile per Azioni, Pomigliano d'Arci, Italy

[21] Appl. No.: 783,563

[22] Filed: Oct. 28, 1991

[30] Foreign Application Priority Data

Oct. 31, 1990 [IT] Italy ..... 53355/90[U]

[51] Int. Cl.[5] ..... B05B 1/30

[52] U.S. Cl. ..... 239/585.1; 251/129.15; 251/129.21; 239/585.5

[58] Field of Search ..... 239/585.1, 585.2, 585.3, 239/585.4, 585.5; 251/129.21, 129.15, 129.22

[56] References Cited

U.S. PATENT DOCUMENTS

| | | | |
|---|---|---|---|
| 2,675,022 | 4/1954 | Bohn | 137/597 |
| 3,464,627 | 9/1969 | Huber | 239/585.3 |
| 3,610,529 | 10/1971 | Huber | 239/585.3 |
| 4,566,416 | 1/1986 | Berchtold | 239/585.1 |
| 4,870,943 | 10/1989 | Bradley | 123/558 |
| 4,905,907 | 3/1990 | Ricco | 239/585.1 |
| 4,946,106 | 8/1990 | Turchi et al. | 239/585.1 |
| 5,067,658 | 11/1991 | De Matthaeis et al. | 239/585.3 |

FOREIGN PATENT DOCUMENTS

| | | |
|---|---|---|
| 0228578 | 7/1987 | European Pat. Off. . |
| 0450532A1 | 10/1991 | European Pat. Off. . |
| 2289755 | 10/1975 | France . |

*Primary Examiner*—Kevin P. Shaver
*Assistant Examiner*—Christopher G. Trainor
*Attorney, Agent, or Firm*—Baker & Daniels

[57] ABSTRACT

An electromagnet housed in a skirt pressed on to a cap integral with the drain conduit of the control valve. The skirt presents two shoulders separated by a distance greater than the height of the core of the electromagnet and on which the core and the cap rest. At least one Belleville washer between the core and the cap holds the core elastically on the respective shoulder and detached from the cap. A retaining ring coaxial with the washer is also provided for sealing the fuel flowing in an axial hole on the core and in the drain conduit.

6 Claims, 2 Drawing Sheets

ASSEMBLY OF AN ELECTROMAGNET CORE OF AN ELECTROMAGNETIC INTERNAL COMBUSTION ENGINE FUEL INJECTOR

BACKGROUND OF THE INVENTION

The present invention relates to an electromagnetic injector for internal combustion engine fuel injection systems.

Injectors of the aforementioned type normally comprise a hollow body with a nozzle, which is opened for injecting the fuel by an electromagnetically-operated control valve for connecting the control chamber of the nozzle to the drain conduit.

On known injectors, the electromagnet comprises a magnetic core having an axial conduit communicating with the drain conduit, which is in one piece with a flange cap supporting the core. The hollow body is fitted inside with a bush having a shoulder on which the surface of the core rests, and a ring pressed on to the cap for connecting the cap to the core and looking the core on to the shoulder.

Locking the core on to a rigid shoulder by means of the above pressing operation presents a number of drawbacks. Foremost of these is possible cracking of the core due to the poor mechanical resistance of the sintered magnetic material of which it is made. Moreover, a similar connection tends to eventually work loose, thus resulting in vibration of the core between the shoulder and flange and relatively short working life of the core.

SUMMARY OF THE INVENTION

It is an object or the present invention to provide an electromagnetic injector featuring straightforward connection of the electromagnet and injector body, so as to overcome the above drawbacks.

According to the present invention, there is provided an electromagnetic injector comprising a hollow body with an injection nozzle; a control valve for connecting a control chamber to a drain conduit and so opening said nozzle; an electromagnet comprising a magnetic core; and a skirt for securing said core to said hollow body, said skirt comprising a first support for said core, and a ring pressed on to a cap; Characterized by the fact that said skirt comprises a second support for said cap; elastic means being provided between said cap and said core for pushing said core on to said first support.

BRIEF DESCRIPTION OF THE DRAWINGS

Two preferred non-limiting embodiments of the present invention will be described by way of example with reference to the accompanying drawings, in which.

DETAILED DESCRIPTION OF THE INVENTION

Figure 1:
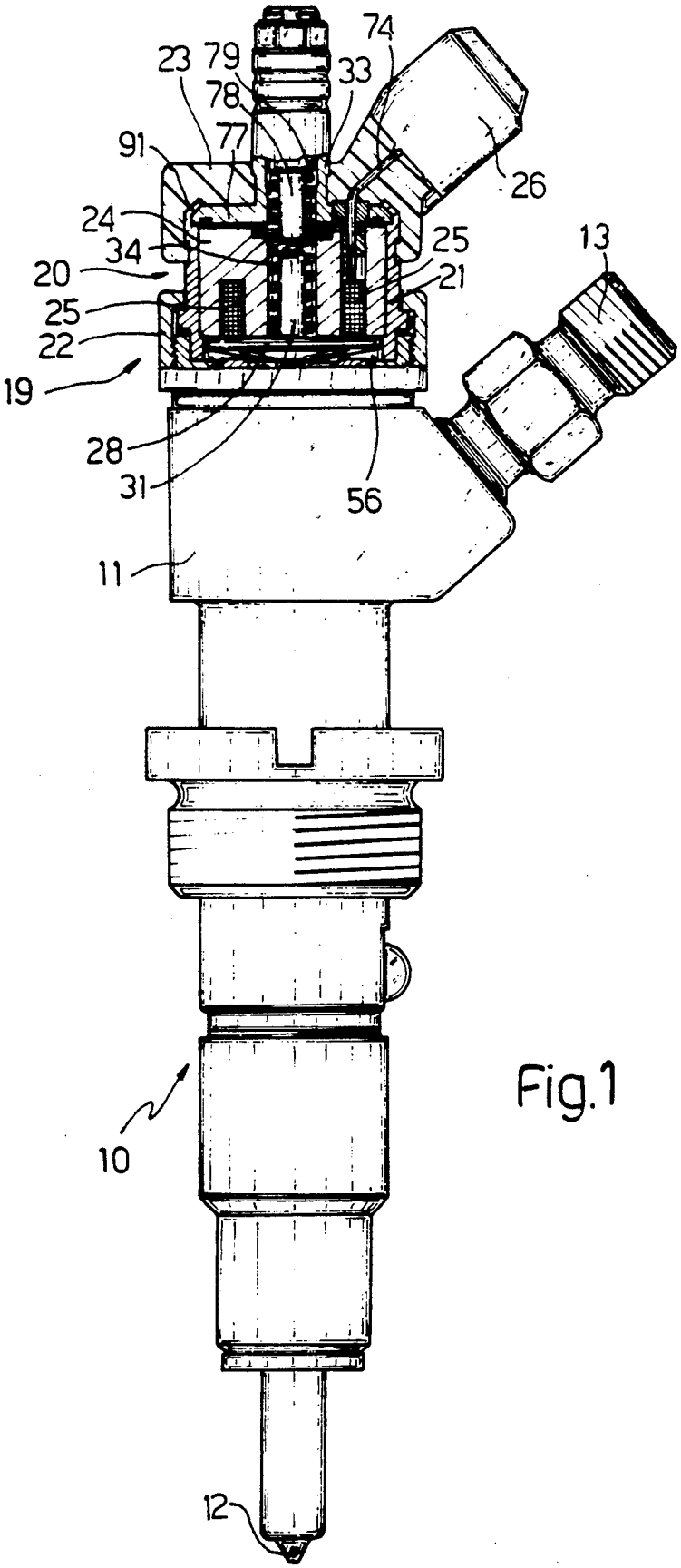
FIG.1 shows a partially-sectioned view of an electromagnetic injector in accordance with the present invention.

Number 10 in FIG.1 indicates an internal combustion engine fuel injector comprising a tapered hollow body 11 closed at the top by a normal co-molded plastic cover 23. At the bottom, body 11 presents an injection nozzle 12 communicating with a normal high pressure (e.g. 1500 bar) chamber not shown.

The high pressure chamber is supplied, in known manner, by an input conduit in turn supplied by a high pressure (e.g. 1500 bar) pump not shown.

Figure 2:
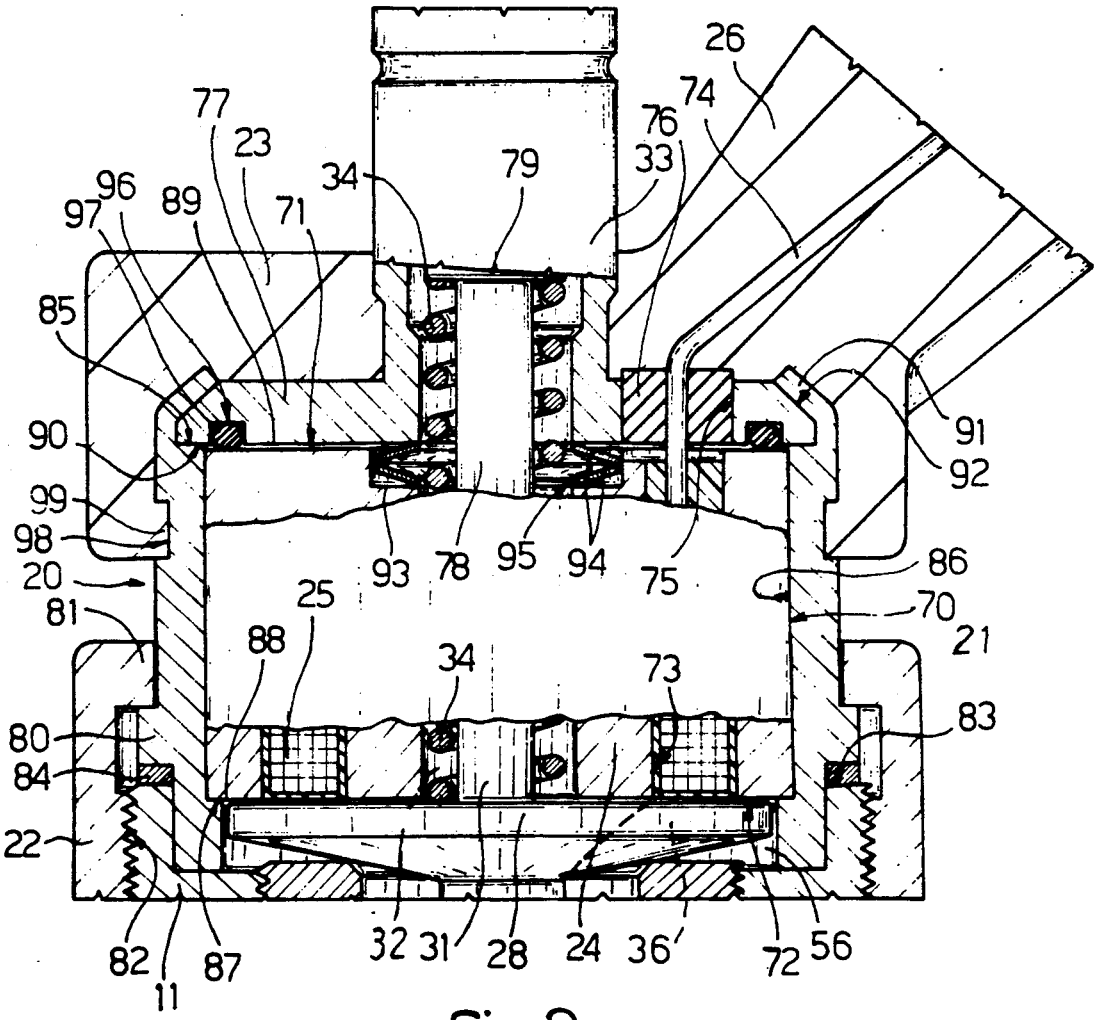
FIG.2 shows a larger-scale partial section of the FIG.1 injector.

Nozzle 12 is opened by a control valve 19 for draining fuel from a control chamber (not shown) into drain chamber 56. Valve 19 is controlled by an electromagnet 20 on body 11, as described in more detail later on. Electromagnet 20 comprises a magnetic core 24 having a cylindrical outer surface 70 (FIG.2), a flat top surface 71, and a flat bottom surface 72. Surface 72 presents an annular seat 73 housing an electric coil 25 supplied by an electric terminal 74 on appendix 26 of co-molded cover 23.

Core 24 comprises an axial conduit or hole 32 communicating at the bottom with drain chamber 56 and, at the top, with a drain conduit comprising a metal sleeve 33 and communicating with the fuel tank. Sleeve 33 is in one piece with a cap consisting of a flange 77 having a passage 75 in which is inserted a plug 76 of insulating material for the passage of terminal 74.

Electromagnet 20 controls an anchor consisting of a disc 28 fitted to a rod 31 housed inside hole 32 and arrested on a coaxial stop pin 78. Pin 78 is in one piece with an adjustable pin 79 inserted inside sleeve 33, which presents axial grooves enabling fuel passage from chamber 56 through hole 32 and sleeve 33 into the tank. Between pin 79 and disc 28, there is provided a helical compression spring 34 guided internally by pin 78 and rod 31, and which provides for downward return of disc 28. Disc 28 presents a radial opening 36 enabling fuel to circulate in chamber 56 through disc 28.

Electromagnet 20 is supported on a skirt of non-magnetic metal material consisting of a substantially cylindrical bush indicates as a whole by 21. Bush 21 presents a bottom cylindrical inner surface 29 laterally defining drain chamber 56, and an outer annular rib 80 engaged by edge 81 of a threaded ring nut 22.

Ring nut 22 is screwed inside a threaded seat B2 on hollow body 11 for securing bush 21 to body 11. In particular, the bottom end of bush 21 rests on a flat annular surface of hollow body 11, and a retaining ring 84 (of the type known as an 0-ring) is inserted for sealing purposes between rib 80 of bush 21 and sealing surface 83 of body 11.

Bush 21 also presents a cylindrical surface 86 housing core 24 and having a diameter equal to that of lateral surface 70 of core 24 and greater than that of surface 29. Between surfaces 72 and 29, there is formed a shoulder 87 perpendicular to the axis of bush 21 and on which edge 88 of bottom surface 72 of core 24 rests. Annular portion 85 of bottom surface 89 of flange 77 rests on a second shoulder 90 of bush 21, also perpendicular to the axis of bush 21. Shoulder 90 forms a thin ring 91 of bush 21, which is pressed on to the inclined edge 92 of flange 77.

Core 24 also presents a recess 93 at the top end of hole 32, for housing elastic means operating between core 24 and flange 77. Said elastic means consist of two Belleville washers 94 for pushing core 24 downwards with edge 88 of surface 72 resting elastically on shoulder 87. Washers 94 present a central opening 95 for the passage of pin 78 and helical spring 34.

The distance between shoulders 87 and 90 is slightly greater than the height of lateral surface 70 of core 24, so that, on the one hand, top surface 71 of core 24 is kept permanently detached from bottom surface 89 of flange 77, while, on the other, core 24 and flange 77 remain connected to each other inside bush 21. Moreover, core 24 and flange 77 are supported independently on bush 21, while core 24 is maintained elastically on shoulder 87.

Flange 77 presents an annular seat 96 housing a retaining ring 97, e.g. a round-section 0-ring, of such a side as to be compressed between seat 96 and surface 71 of core 24, with its section so deformed as to seal the low-pressure fuel from hole 32 to sleeve 33. Finally, bush 21 presents an outer groove 98 engaged in known manner by edge 99 of co-moded cover 23, thus completing the assembly of injector 10.

The advantages of the injector according to the present invention will be clear from the foregoing description. In particular, core 24 is in no way stressed by the pressing of ring 91, which is withstood solely by flange 77, and is so mounted as to prevent it from working loose and to enable any slack to be taken up on shoulder 87.

To those skilled in the art it will be clear that changes may be made lo the injector as described and illustrated herein without, however, departing from the scope of the present invention. For example, Belleville washers 94 may be other than two in number or replaced by other elastic means; and ring 96 may be located adjacent to recess 93 instead of annular portion 85.

We claim:

1. An electromagnetic injector for internal combustion engine fuel injection systems, comprising a hollow body (11) with an injection nozzle (12); a control valve (19) for connecting a control chamber to a drain conduit (33) and so opening said nozzle (12); an electromagnet (20) comprising a magnetic core (24); and a skirt (21) for securing said core (24) to said hollow body (11), said skirt (21) comprising a first support (87) for said core (24), and a ring (91) pressed on to a cap (77); characterized by the fact that said skirt (21) comprises a second support (90) for said cap (77); elastic means (94) being provided between said cap (77) and said core (24) for pushing said core (24) on to said first support (87).

2. An injector as claimed in claim 1, wherein said skirt consists of a substantially cylindrical bush (21), and wherein said core (24) is cylindrical and housed in said bush (21), characterized by the fact that said supports consist of two shoulders (87, 90) of said bush (21) perpendicular to the axis of said bush (21) and separated by a distance greater than the height of said core (24), so that said core (24) is held elastically on said respective shoulder (87) by said elastic means (94).

3. An injector as claimed in claim 2, wherein said core (24) presents an axial conduit (32) communicating with said drain conduit (33), and wherein said cap consists of a flange (77) integral with said drain conduit (33), characterized by the fact that said flange (77) presents an annular portion (85) resting on said respective shoulder (90).

4. An injector as claimed in claim 1, characterized by the fact that said elastic means comprise at least one Belleville washer (94) located between said cap (77) and said core (24) and housed in a seat (93) on said core (24) adjacent to said axial conduit (32).

5. An injector as claimed in claim 4, wherein said drain conduit (33) houses an axial pin (78) for arresting an anchor (28) of said electromagnet (20), and a helical spring (34) for returning said anchor (28), characterized by the fact that said washer (94) presents a central opening (95) for the passage of said pin (78) and said helical spring (34).

6. An injector as claimed in claim 1, and comprising sealed connecting means (97) between said core (24) and said cap (77), characterized by the fact that said connecting means comprise a sealing ring (97) of elastic material housed in an annular seat (96) on said cap (77) coaxial with said drain conduit (33).

* * * * *